US008485104B2

(12) United States Patent
Nemeth et al.

(10) Patent No.: US 8,485,104 B2
(45) **Date of Patent: *Jul. 16, 2013**

(54) AMUSEMENT PARK RIDE SYSTEM WITH CROSSING PATHS

(71) Applicant: Disney Enterprises, Inc., Burbank, CA (US)

(72) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/736,306

(22) Filed: Jan. 8, 2013

(65) Prior Publication Data

US 2013/0118370 A1 May 16, 2013

Related U.S. Application Data

(63) Continuation of application No. 13/182,648, filed on Jul. 14, 2011, now Pat. No. 8,371,227.

(51) Int. Cl.
*A63G 31/00* (2006.01)

(52) U.S. Cl.
USPC ..... 104/53

(58) Field of Classification Search
USPC ..... 104/53, 63, 89, 118, 172.1, 172.2, 104/172.3, 172.4, 172.5, 139, 140, 141, 146; 472/36, 37, 43, 59, 60; 105/141, 148, 149.1, 105/149.2, 176, 177
See application file for complete search history.

(56) References Cited

U.S. PATENT DOCUMENTS

| | | | |
|---|---|---|---|
| 2,601,832 | A | 7/1952 | Hester |
| 3,699,896 | A | 10/1972 | Giraud |
| 4,050,385 | A | 9/1977 | Gurr et al. |
| 4,347,791 | A | 9/1982 | Mandros |
| 4,920,890 | A | 5/1990 | Barber |
| 5,970,882 | A | 10/1999 | Smith et al. |
| 6,170,402 | B1 | 1/2001 | Rude et al. |
| 6,796,908 | B2 | 9/2004 | Weston |
| 7,739,958 | B2 | 6/2010 | Gordon |
| 7,802,522 | B2 | 9/2010 | Gordon |
| 7,921,781 | B2 | 4/2011 | Baker et al. |
| 2001/0018370 | A1 | 8/2001 | Arie |

(Continued)

FOREIGN PATENT DOCUMENTS

WO 2006076792 7/2006

*Primary Examiner* — Mark Le
*Assistant Examiner* — Jean Charleston
(74) *Attorney, Agent, or Firm* — Marsh Fischmann & Breyfogle, LLP; Kent A. Lembke

(57) ABSTRACT

A ride system with crossing ride paths. A first assembly is provided that includes a first set of vehicles movable along a first ride path, and the first vehicle set is vertically supported above the track at a first height. A second assembly is provided with a second set of vehicles movable along a second ride path that differs from the first ride path and crosses over the first ride path when viewed in plan view. The second vehicle set is vertically supported below the upper vehicle track at a second height, which may be the same as the first height such that passengers perceive a collision risk at path intersections. The upper track is at a higher elevation than the lower track such that track crossovers occur without interference. A synchronization mechanism synchronizes movement of the upper and lower sets of vehicles to avoid collisions at crossover points.

13 Claims, 6 Drawing Sheets

U.S. PATENT DOCUMENTS

2005/0098058 A1 5/2005 Baugh
2007/0089630 A1 4/2007 Gordon
2008/0202374 A1 8/2008 Muller et al.
2009/0031913 A1 2/2009 Heaslip et al.
2009/0065653 A1 3/2009 Vance et al.

AMUSEMENT PARK RIDE SYSTEM WITH CROSSING PATHS

CROSS-REFERENCE TO RELATED APPLICATIONS

This application is a continuation of U.S. patent application Ser. No. 13/182,648, filed Jul. 14, 2011, which is incorporated herein by reference in its entirety.

BACKGROUND

1. Field of the Description

The present description relates, in general, to providing amusement park rides that provide high throughput or daily capacities with added thrill and unpredictability. More particularly, the present description relates to a ride system (or ride, ride apparatus, or the like) using the concept of an omnimover ride system in which two or more synchronized chains of vehicles or set pieces have crossing paths so as to provide unexpected close calls and to also provide coordinated movements between vehicles and between vehicles and set pieces.

2. Relevant Background

Amusement and theme parks continue to be popular worldwide with hundreds of millions of people visiting the parks each year. Historically, park operators provided walk-through attractions that presented artwork, music/soundtracks, and special effects with museum, haunted house, movie and book-based, other themes. These attractions were popular with many visitors of the parks, but park operators had difficulty increasing the daily capacity of such attractions because many visitors or attraction participants would linger in various portions of the attraction or even reverse direction in an attempt to visit prior portions of the attraction. As a result, walk-through attractions have generally been replaced by attractions in which the visitors (or passengers) ride in vehicles along a track or path through the attraction.

With the goal of higher ride or attraction capacity in mind, an omnimover is a ride system that has been developed to provide an experience that is similar to a walk-through experience or ride-through tour as it moves guests at speeds similar to walking speed such as less than about 2 feet per second. The omnimover is a ride system used for theme park attractions such as haunted houses or movie-based theme attractions in which two, three, or more passengers sit in a vehicle that is towed or moved along a track. The omnimover ride system includes a large number of such vehicles that are each attached or linked into a continuous loop or chain. The vehicle chain moves along a track, and the track is typically hidden beneath a floor. The vehicles ride on wheels or bogies mating with a track or pair of rails. Additional cam or control rails may be provided to control individual rotation or swivel of the vehicles to orient the passengers toward various show features (e.g., turn a vehicle to the left or right to cause the passengers to view a show or entertainment feature of the ride) and/or to keep the vehicles level as the track ascends or descends on sloped portions of the attraction. These motions may also be achieved with electric motors.

The chain of vehicles is kept in continuous and predictable motion, typically at a constant speed, throughout the entire course of the attraction. High throughput or increased daily capacity is achieved because the vehicle chain continues to move throughout the day, with riders loading and unloading while the vehicles are in motion. Standard loading and unloading occur with a next set of passengers standing on a loading belt, which is moving at about the chain/vehicle speed, entering adjacent vehicles and, at a different location or station, passengers in vehicles exiting their moving vehicle onto an adjacent unloading belt, which is also moving at about the speed of the chain/vehicle.

The omnimover ride system continues to provide a popular platform for rides in many amusement parks as the omnimover ride system effectively delivers high capacity with a simple mechanical drive and control system. One consideration, though, with the use of omnimover ride systems is that due to the constant speed and limited vehicle movements the ride experience is relatively predictable and provides a similar experience regardless of the show. Hence, there remains a need for a ride system that provides the high capacity or passenger throughput of a conventional omnimover ride but that also provides a new, unique, fun, exciting, and unpredictable ride experience. Preferably, such a ride system would increase immersion into the ride experience and enhance variability while preserving the benefits of conventional omnimover rides.

SUMMARY

The present description addresses the above and other problems by providing a ride system that uses two or more omnimover ride systems or assemblies to provide unpredictable and unexpected rides with the desired high capacity of more conventional omnimover rides. The ride systems described herein may include a first or lower omnimover ride assembly and a second or upper ride assembly, and each are configured to drive a chain of passenger vehicles along a track, and the vehicle chain and interconnected vehicles are typically moved at a constant speed (e.g., by a track-mounted drive system such as at 1 to 4 feet per second, with 2 feet per second being useful in many cases). The vehicles of the lower omnimover ride assembly are vertically supported from below to be positioned above the lower track and its track-mounted drive system while the vehicles of the upper omnimover ride assembly are vertically supported from above to be positioned below the upper track and its track-mounted drive system.

Significantly, the vehicles of each ride assembly (in each continuous chain of vehicles) are spaced apart an adequate distance such that a vehicle from the other omnimover ride assembly may be positioned between each adjacent pair and/or can pass through the adjacent vehicle pairs. This is important because the tracks of the upper and lower omnimover ride assemblies are arranged to provide at least one cross over point or location. The cross over, without any true or actual risk of a vehicle collision, is achieved by arranging the two tracks such that their paths (or vehicle paths) appear to intersect when viewed from above or in a plan view of the ride system, but the upper and lower tracks do not actually cross in a single plane and vehicles from the upper and lower chains of vehicles pass between each other without physical contact.

The two assemblies are synchronized with a synchronization assembly such that vehicles from only one of the two omnimover ride assemblies are present at the cross over point or path intersection at a particular time, e.g., a vehicle from the lower assembly passes between two adjacent vehicles of the upper assembly to provide a near collision or close call experience. In certain portions or segments of the ride system, such as at loading, the paths may overlap for a distance or length with the vehicles of the two omnimover assemblies intermixed or provided in an every-other or alternating pattern (e.g., a vehicle from the lower assembly followed by a vehicle from the upper assembly followed by a vehicle from the lower assembly and so on as is made possible by the proper spacing of the vehicles in their chains and also by the synchronization of the two omnimover ride assemblies).

Initially, it may be useful to describe several of the significant differences between conventional omnimover and other rides and the omnimover ride systems described herein that are configured to provide crossing and/or overlapping vehicle ride paths. First, the inventors' ride systems include at least two synchronized omnimover ride assemblies. This allows the ride system to have dedicated (and separate) upper and lower track structures, e.g., with tracks spaced apart by a vertical distance greater than a height of the supported vehicle and any vertical supports (e.g., central poles/posts). The ride system also can then have associated vehicles arranged so that the upper and lower tracks of the two omnimover ride assemblies appear to cross each other when they are observed in a plan view. Vehicles guided by separate tracks (or driven by drive systems on separate tracks) may be located at the same elevation or height (e.g., relative to a floor or base of the ride system) in portions of the ride system. For example, a vehicle in the lower omnimover ride assembly and a vehicle in the upper omnimover may be at the same height at track intersections or cross over points so that it appears to the passengers and observers that the two vehicles may collide, e.g., as a vehicle linked into a first continuous chain passes between two vehicles linked into a second continuous chain.

The track-supported vehicles of each omnimover ride assembly are connected into a continuous chain of fixed length, and an off board, track-mounted drive system typically moves the vehicle chain at a constant and fixed speed along the track (e.g., each vehicle may be linked to its adjacent vehicles to form a continuous vehicle chain or chain of vehicles (or each vehicle may be linked to a chain/cable or the like) and a track-mounted drive system may move the chain of vehicles along the track). In contrast to other omnimover ride systems, though, a coupling or synchronization mechanism is provided in the ride system to ensure the vehicles of the upper and lower omnimover ride assemblies remain positionally synchronized throughout the entire ride system, which allows the "close calls" at the intersecting and overlapping track portions of the ride.

More particularly, a ride system is provided that includes crossing vehicle paths (or at least paths that appear to cross when the system is viewed in plan view), which provides vehicle near-collision experiences or close interaction among passengers of such vehicles. The ride system includes a first omnimover assembly with an elongate track defining a first ride path and further with a first drive system mounted to the track of the first omnimover assembly. The first omnimover assembly also includes a plurality of vehicles connected to the first drive system such as into a continuous vehicle chain of fixed length (e.g., the vehicles are interconnected with each vehicle making up a link in the chain or vehicles are interconnected via a drive element such as a chain to form a chain of vehicles), and the vehicles are vertically supported at a first height above the track of the first omnimover assembly and during operation of the drive system are moved along the elongate track (or supporting track structure). The ride system also includes a second omnimover assembly with an elongate track defining a second ride path and further with a second drive system mounted to the track of the second omnimover assembly. The second omnimover assembly includes a plurality of vehicles connected to the second drive system such as into a continuous vehicle chain of fixed length. The vehicles are vertically supported at a second height below the track of the second omnimover assembly and during operation of the drive system are moved along the elongate track (or supporting track structure).

In practice, the track of the second omnimover is spaced apart from, and at a higher elevation than, the track of the first omnimover assembly (e.g., the first or lower track may be placed under a false floor while the second or upper track is placed above a false ceiling). The ride system further includes a synchronization mechanism that operates to synchronize movements of the vehicle chains of the first and second omnimover assemblies such that the two vehicle chains move at the same speed or rates along their respective tracks and, thus, the vehicles also move along the ride paths defined by such track structures at the same speeds, which maintains the upper and lower vehicle chains and their linked or driven vehicles in synched locations relative to each other to avoid collisions.

In the ride system, the first path typically differs significantly from the second path and the first ride path crosses or intersects the second ride path at a cross over point when the ride system is viewed in plan view (but without true/actual interference between the two tracks due to the differing track elevations in the ride system). In such embodiments, adjacent vehicles in the first omnimover assembly and in the second omnimover assembly are spaced apart at least a length of a body of one of the vehicles, and the vehicles are positioned on the first and second ride paths such that the vehicles from each of the first and second omnimover assemblies alternately pass through the cross over point without contacting vehicles on the other assembly.

In some embodiments of the ride system, the first and second ride paths coincide, when the ride system is viewed in plan view, for a length greater than about two of the vehicles. For example, this portion of the ride path may be used to load or to unload the vehicles, with the vehicles appearing to be members of a single vehicle chain until the two ride paths split into two distinct and separate paths. In the ride system, the vehicles may be positioned relative to each other in the first and second omnimover assemblies such that in the coinciding length the vehicles from the first and second omnimover assemblies are alternated along the coinciding length.

In some implementations, the synchronization mechanism includes a coupling assembly mechanically coupling the vehicle chain of the first omnimover assembly to the vehicle chain of the second omnimover assembly. For example, the synchronization mechanism may include a drive mechanism driving a first one of the vehicle chains to move along the first or second track, whereby the second one of the vehicle chains is driven to move along the other of the first and second tracks via the coupling assembly. In other embodiments, the synchronization mechanism includes a control system that monitors operation of separate drives used to drive the two vehicle chains along the first and second tracks and then adjusts the separate drives or drive systems as necessary to match the rates of the separate vehicle chains and/or to assure ongoing positional synching of the vehicles on each track to avoid collisions at cross over or intersection points between the two tracks.

DETAILED DESCRIPTION

Figure 1:
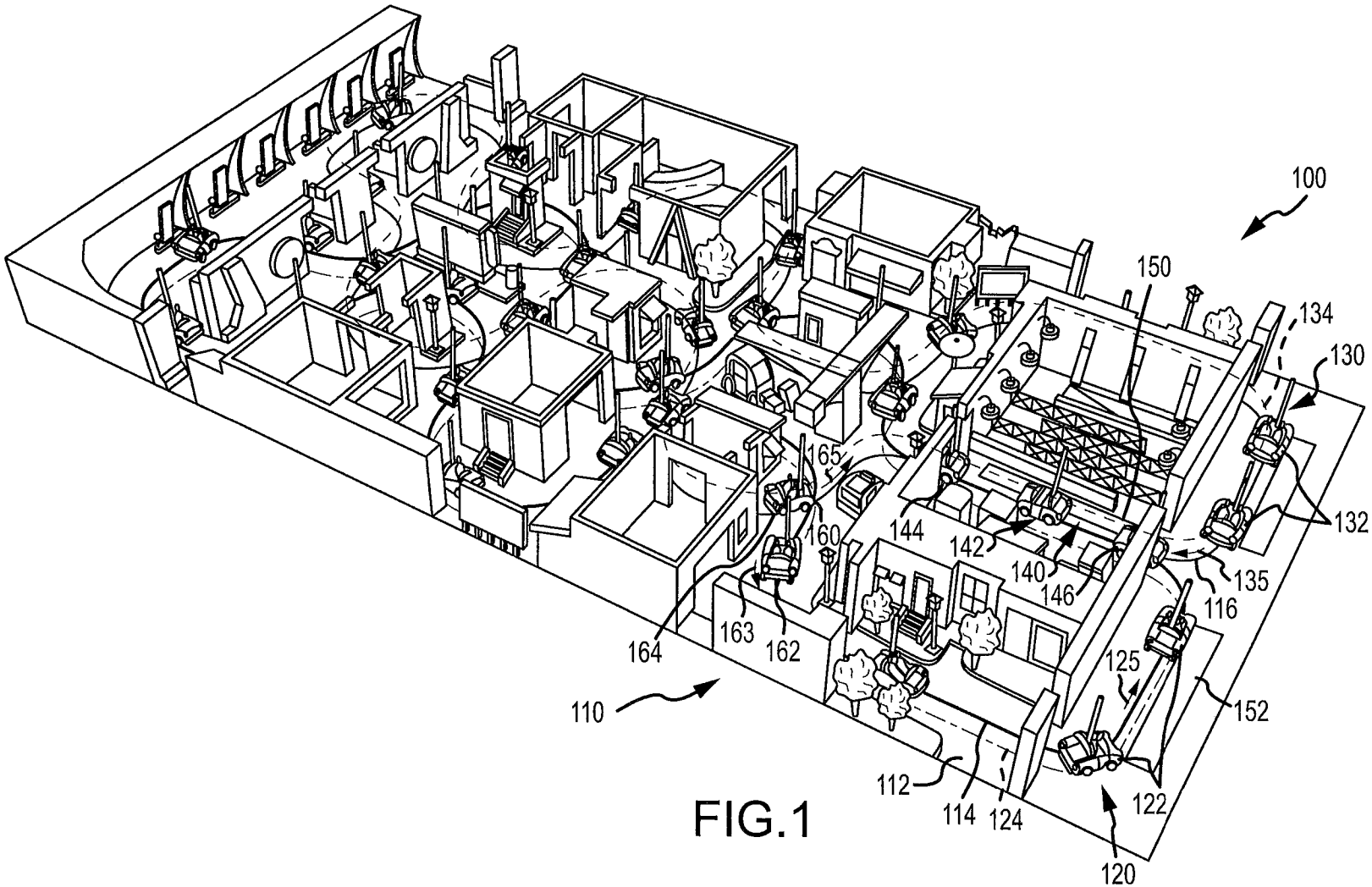
FIG. 1 is a perspective, overhead view of a ride system or omnimover-type amusement park ride with a ceiling and overhead track (and drive) removed to better illustrate the ride system's use of two omnimover assemblies to place vehicles in safe, near-collision positions.

Embodiments of the present description are directed to a path-crossing omnimover ride or ride system that utilizes two (or more) separate omnimover assemblies. The two assemblies each have a track (e.g., an upper and a lower track) that is supported at different elevations such that one track is located under the passenger vehicles that it guides through the ride while the other track is located overhead or above the passenger vehicles it guides and/or supports. The arrangement of the tracks, when combined with adequate vehicle-to-vehicle spacing within upper and lower (continuous) vehicle chains driven by drive systems mounted to the upper and lower tracks, allows the vehicle paths from the separate omnimover assemblies to cross (when viewed from above or in a plan view) without interference.

Generally, the path-crossing omnimover ride system may be implemented with: (a) a lower vehicle chain that includes multiple vehicles linked together to form a continuous loop or chain of vehicles; (b) a lower vehicle track that supports the vehicles of the lower vehicle chain; (c) an upper vehicle chain that includes multiple vehicles linked together into a chain or a continuous loop; (d) a lower vehicle track that supports the vehicles of the upper vehicle chain; and (e) a drive and synchronization mechanism that moves the upper and lower vehicle chains along their tracks and also that ensures synchronization/timing of movement of the individual vehicle chains so as to guarantee vehicle spacing and timing at track crossing points. To this end, the lower and upper vehicle tracks (and the associated vehicle chains) intersect or cross at one or more of such crossing points that are apparent when the two tracks are viewed from above (or below) such as in plan view.

In some particular implementations, the lower vehicle track may be located beneath a floor, and the vehicles attached into the lower vehicle chain may be supported on structural elements that extend up through a slot in the floor. The upper track may then be located above a ceiling, and vehicles of the upper vehicle chain may be supported on structural elements that extend down through a slot in the ceiling. The vehicles connected into the two chains may be vertically supported to be at the same or differing elevations relative to the floor, with the same elevation (or an overlapping elevation) being useful for making crossings of intersection or cross over points of the two tracks exciting (close calls for collisions). More specifically, the ride system is often most interesting when the vehicles linked into the upper and lower vehicle chains are mounted at the same (or an overlapping) elevation or height since this gives the impression to the passengers that a collision is possible.

The synchronization system or mechanism may be a control system that coordinates the motion of independent electric drive systems that separately move the upper and lower vehicle chains while monitoring and adjusting vehicle positions and speeds to ensure synchronization. In other embodiments, though, the synchronization system may be provided by use of a single drive system that drives both the upper and lower vehicle chains at a single, and typically constant, speed. For example, the shared drive (or drives) may be provided at or near intersection points of the two tracks or where the two tracks overlap. In some embodiments, more than two separate chains of vehicles are provided in the ride system, and, in such cases, the ride system may include multiple synchronization systems/mechanisms that connect the three or more separate vehicle chains. This may be used to provide additional passenger-carrying vehicle chains and/or to integrate and synchronize show vehicles/elements into the ride experience.

Passengers may load onto the vehicles from load/unload belts similar to current omnimovers. There may be separate belts for each of the two (or more) tracks, but the ride experience may be more interesting when the separate tracks (or their associated vehicle paths) overlap in the load (or unload) portion or station area to make it appear as though all the vehicles are supported on a single track rather than two or more. This loading condition contributes to the surprising nature or unpredictable aspects of the ride system as adjacent vehicles separate after loading to follow their respective vehicle paths (above or below the supporting tracks). As with other omnimovers, the vehicles may each be capable of spinning under show control, under passenger control, or under the effects of free dynamics.

FIG. 1 illustrates a partial perspective view of a ride system 100 of an embodiment of the present invention. As shown, the ride system 100 includes a structural or support assembly 110 that includes a floor 112 and numerous walls 113 extending upward from the floor 112 to define pathways and rooms for vehicles to pass and for display of show elements of the ride system 100.

Further, the floor 112 includes a slot or groove 114 for vehicles of a lower omnimover ride assembly 120 and a slot or groove 116 for vehicles of an upper omnimover ride assembly 130. Generally, a vertical support such as a pole or a post will extend from the vehicles and extend through the slots 114, 116, with the pole being a true vertical support of the lower assembly vehicles and a false or decorative support for the upper assembly vehicles as these are supported from above by the upper omnimover ride assembly 130. In this way, the vehicles appear to be riding in the slots 114, 116 over the floor 112. The structural or support assembly 110 typically also includes a ceiling that has been removed to allow view of the ride system 110 components. The ceiling would include a groove/slot similar to the slots 114, 116 for receiving vertical supports (actual and false/decorative) extending from the vehicles, and the ceiling is used to hide the existence and operation of the upper omnimover ride assembly 130 (e.g., to hide the fact that vehicles are being moved by an upper omnimover as well as by the hidden lower omnimover).

Significantly, the ride system 100 includes a lower omnimover ride assembly 120 and an upper omnimover ride assembly 130. The lower omnimover ride assembly 120 includes numerous vehicles (passenger and/or show element cars or vehicles) 122 that are linked together to form the vehicle chain 124. The vehicle chain 124 (or the vehicle interconnection and/or portions that are driven and its supporting track) is positioned below the floor 112 and is moved (by a drive assembly not shown in FIG. 1) at a speed, which causes the vehicles 122 to move as shown by arrow 125 along a ride or vehicle path coinciding with the groove 114 and the location of the vehicle chain 124 in the support structure assembly 110 (and the vehicle chain 124 typically is driven along a track structure such as by a track-mounted drive system and such a track structure is used, too, to support the vehicles 122). As mentioned above, the vehicles 122 may be vertically supported from below by a support (e.g., a post/pole or the like) extending from the interconnection with the vehicle chain 124 and/or a support track through the slot/groove 114 to the body of each vehicle 122.

Likewise, the upper omnimover ride assembly 130 includes numerous vehicles 132 that are linked together to form an upper vehicle chain 134 and its associated track structure (e.g., positioned above a ceiling (not shown)), and the upper vehicle chain 134 is driven at one or more speeds, by a track-mounted drive system or the like, to cause the vehicles 132 to move as shown by arrow 135. This causes the vehicles 132, which are vertically supported from above by a support (e.g., a post/pole or the like) linked to the upper vehicle chain 134 and/or a track structure, to move along a ride or vehicle path coinciding with the groove 116 and the location of the vehicle chain 134 (or, more accurately, its associated track structure) in the support assembly 110. Also, as discussed above, the ceiling may have a slot similar to slot 116 (and parallel to slot 116) through which the vertical vehicle support or pole would extend to link each vehicle 132 to the moving/movable vehicle chain 134 riding along a track structure above the floor 112. The vehicles 122, 132 may also include false/decorative vertical supports that extend from the vehicle bodies in a direction unrelated to their drive track so as to disguise or hide that the vehicles 122 are driven from and supported from below while the vehicles 132 are driven and supported from above. For example, a pole may extend from the lower vehicle chain 124 (and/or a supporting track) through a vehicle 122 to a distance or height above the vehicle body so as to extend into a slot/groove in the ceiling (and vice versa for the vehicles 132).

As shown, the vehicles 122, 132 are being supported at the same elevation or height above the floor 112 (e.g., a small clearance of a few inches to about 1 foot). Collisions appear to be a possibility. However, adjacent vehicles 122 and adjacent vehicles 132 are spaced apart from each other to allow another vehicle to pass through at intersections or cross over points and, in this embodiment, at overlapping segments of the tracks (or vehicle/ride paths) in the ride system 100. As shown, the omnimover tracks and the vehicle chains 124, 134 riding on such tracks are arranged to define two differing ride paths or vehicle-travel patterns through the support structure 112. These two differing ride paths basically match the arrangement of the tracks and their associated vehicle chains 124, 134 and the grooves/slots 114, 116. This allows vehicles 122 to be moved through a first set of locations in the structure 110 to see differing show elements and experience a different ride experience than those seen by the vehicles 132, which are moved through a second set of locations in the structure 110.

Specifically, as shown in the embodiment 100, the ride system 100 includes a load segment or section 140 in which the tracks and vehicle chains 124, 134 overlap (when viewed from above or in plan view) and slots/grooves 114, 116 coincide in the floor 112 (and the false ceiling). In this loading segment 140, the vehicles 122, 132 are intermixed in an alternating manner with the lower vehicle 142 shown to be positioned or interposed between adjacent upper vehicles 144, 146. A loading conveyor belt 150 is provided parallel to the groove/slot 114, 116 in the loading segment 140 to allow passengers to easily and safely board the moving vehicles 142, 144, 146, and the vehicles 142, 144, 146 appear to be part of a single chain of vehicles rather than two until a split occurs and the grooves/slots 114, 116 split to follow differing ride/vehicle paths defined by the tracks and their supported vehicle chains 124 and 134. This spitting provides a first surprise to the passengers ("where are we going?" "why aren't we following that vehicle?" and "how do they separately move the cars?"). Unloading may be performed similarly along a section of the tracks that are overlapping or, as shown, separate unloading belts 152 may be provided at points where the slots/grooves 114, 116 do not coincide and the tracks are separated by some distance.

A next surprising ride experience occurs at a cross over or intersection point of the tracks and vehicle chains 124, 134. For example, intersection/cross over point 160 illustrates a location in the ride system 100 in which the lower track and its vehicle chain 124 and upper track and its vehicle chain 134 appear to be in the same location and to cross over each other when viewed from above (or below) or in a plan view of the ride system. As discussed above, the vehicles 122 and 132 are vertically supported so as to be at the same elevation (or to have some overlap in their position of their vehicle bodies) relative to the floor 112, and this causes the passengers to fear or expect a collision between the vehicles 122, 132 as they pass through the intersection point 160. However, the vehicle chains 124, 134 are synchronized to move at the same speed 125, 135 and the locations of the vehicles 122, 132 in the vehicle chains for the upper and lower omnimover ride assembles 120, 130 are selected so as to leave an adequate space between vehicles of a chain for a vehicle in the other chain to pass at the intersections or cross over points such as point 160.

As shown, the lower vehicle 162 travels 163 through the intersection or cross over point 160 immediately (or shortly) before the upper vehicle 164 travels 165 through this point 160, which simulates a near miss or near collision as the passengers in both vehicles 162, 164 can easily see each other (and the vehicles may be rotated to enhance the viewing of the oncoming vehicle(s)). The ride system 100 allows for two separate omnimover tracks and the associated vehicle chains 124, 134 to continuously and frequently cross or overlap paths while maintaining consistent vehicle spacing and timing and ensuring vehicles 122, 132 on separate upper and lower omnimover tracks and linked into vehicle chains 124, 134 cannot possibly collide. This delivers an experience with exciting and unexpected near miss opportunities while also allowing for more standard dark ride show scenes in the ride system 100.

Vehicles, such as adjacent pairs of vehicles 122 or 132, are spaced further apart than on a standard omnimover, which provides more intimate interactions with show and "triggered" effects that are directed to a specific vehicle (e.g., cannot as readily hear reactions and conversations of riders in nearby vehicles). There are also variable experience opportunities in the ride system 100 as the upper and lower tracks along which vehicle chains 124 and 134 move define two separate paths for much of the ride system 100 or length of the ride/vehicle path such that a rider will need to ride more than once to get onto differing chains of vehicles. The show environment in the ride system 100 may be very dynamic and chaotic as vehicle chains overlap (at loading section 140) and cross each other (at intersection/cross over points 160) to provide lots of interesting and unpredictable vehicle motion through the show spaces defined by and in the structure 110.

Figure 2:
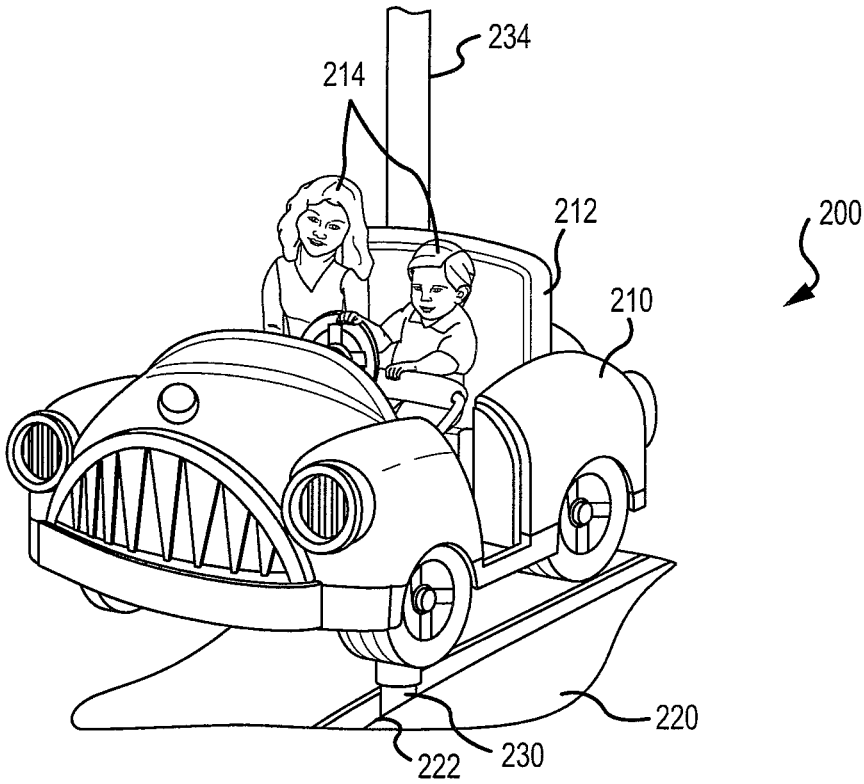
FIG. 2 illustrates a passenger vehicle that may be used in the ride system of FIG. 1 and shows use of both a lower vertical support and an upper vertical support (e.g., center poles or the like) with one being used to vertically support the vehicle from above or below for each vehicle of the ride system while the other one is used to disguise/hide whether the vehicle is driven from above or below (e.g., add to unpredictable nature of ride)

FIG. 2 illustrates a passenger vehicle 200 that may be used in a ride system such as for the vehicles 122, 132 of system 100 in FIG. 1. As shown, the vehicle 200 includes a body 210 (that may or may not be themed to suit a particular ride system and its show elements) and the body 210 includes one or more seats or devices 212 for receiving and safely supporting passengers 214 (e.g., 1, 2, 3, 4, or more people that may be restrained in the seats 212 for safety reasons). A "vehicle" may be considered merely the body 210 but, herein, may be considered the interconnection portion with adjacent vehicles to form a chain of such vehicles and may also include portions riding upon/supported by a track and driven along that track by a drive mechanism/system (e.g., a "vehicle" is each link of the vehicle chain including portions that are above and below a false ceiling or floor in the illustrations).

A vertical support is provided that may include a lower vertical support 230, and the lower vertical support 230 is attached to the vehicle 210 at one end and at another end into a vehicle chain (e.g., to a portion driven and supported by a lower track (not shown) and/or to two adjacent vehicles to form a continuous loop or chain of vehicles 200). The lower vehicle chain and track would be a part of a lower omnimover ride assembly and would be used to support and drive/move the vehicle 200 and its associated chain of vehicles through a ride. The ride may include a floor 220 with a groove/slot 222, and the lower vertical support 230 extends through to be attached to and supported by the lower track. In some cases, though, the body 210 is supported from above and the lower support 230 is a false or decorative support that merely extends to or through groove 222 and is not attached or supported by a lower track. When the body 210 is supported from below, the vehicle 200 may optionally include an upper vertical support 234 (e.g., a pole, post, or the like) that is false or decorative in that it gives the impression that the body 210 may be supported from above. Hence, the pole/support 234 typically would extend up to a ceiling and through a groove/slot in that ceiling. In some cases, though, the vehicle 200 is an upper vehicle in that it is vertically supported by the upper support 234 which is attached to an upper vehicle chain to drive the vehicle and is supported via an upper track, which would be a part of an upper omnimover ride assembly and would be used to support vehicle body 210 as it moves along a ride path associated with or defined by the upper track.

Figure 3:
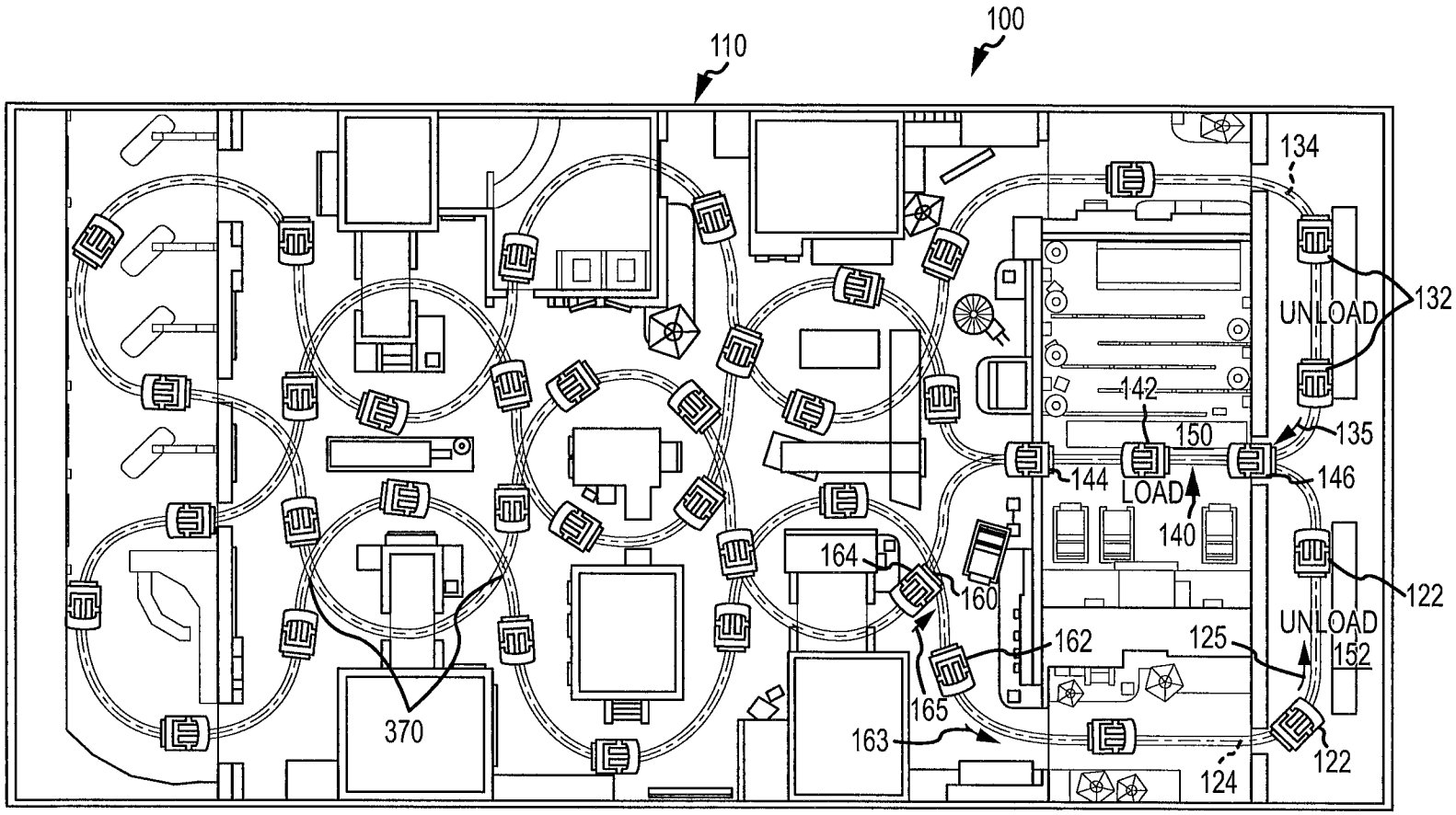
FIG. 3 is a plan (or overhead) view of the ride system of FIG. 1, again with the ceiling removed, showing an exemplary track layout such that the upper and lower tracks have an overlapping section (e.g., the load section in this example) and a number of path or track crossing/intersecting points at which vehicles linked into the two omnimover drive or vehicle chains pass each other (e.g., near misses or close interaction parts of the ride)

FIG. 3 illustrates the ride system 100 of FIG. 1 from above or in plan view. As shown, the vehicle chain 124 and/or associated track of the lower omnimover ride assembly 120 defines a first ride or vehicle path, and the vehicle chain 134 and/or associated track of the upper omnimover ride assembly 130 defines a second ride or vehicle path. Such an arrangement allows a ride designer to provide differing and unique show and ride experiences to the passengers in the two differing vehicle chains. For example, vehicles 122 connected into a first or lower vehicle chain 124 may be moved 125 along the lower track associated with chain 124 through different shows/displays and/or have the vehicles 122 controlled in differing ways (spun differently, caused to go up and down slopes, and so on). Hence, a passenger may want to ride the ride system more than once to experience the full ride.

Further, the ride system 100 is adapted to have an overlapping segment or section 140 that may be used for loading (or unloading) the vehicles, and the vehicles 122, 132 become intermixed such as with vehicle 142 of the lower assembly 120 being positioned between adjacent vehicles 144, 146 of the upper assembly 130. Only one overlapping segment 140 is shown but more can readily be provided, and the length of the overlapping segment 140 may be varied to practice the ride system 100. As shown, the segment 140 has a length of about 5 to 7 vehicle lengths but a shorter or longer segment 140 may be utilized, and the segment 140 in this example is used to provide the illusion that the vehicles 142, 144, 146 are all part of a single vehicle chain until the vehicles 142, 144, 146 veer off onto the separated segments of the paths defined by tracks and the chains 124, 134 driven along such tracks (in the illustrated ride 100, after vehicle loading).

Significantly, the tracks and associated vehicle chains 124, 134 are arranged to have numerous crossing points 160 and 370. In the plan view shown in FIG. 3, the tracks and their associated vehicle chains 124, 134 appear to intersect at points 160, 370. This would not be practical with a single omnimover as a single track would be very difficult to design to allow such cross over. The crossing of the tracks (in plan view) is used to create safe near-collision interactions between the vehicles 122, 132 of the two vehicle chains. This is achieved as shown at intersection 160 by adequately spacing adjacent vehicle pairs in each vehicle chain such that when a space between two vehicles is passing through the point 160 for one chain (such as the space behind moving 163 vehicle 162 in the lower vehicle chain 124) a vehicle (such as moving 165 vehicle 164 in the upper vehicle chain 134) also moves through the cross over point 160. In other words, the positions/locations of the vehicles 122, 132 of each assembly 120, 130 is carefully selected as part of the design of the ride system 100 such that two vehicles 122, 132 are never concurrently at cross over points 160, 370 but instead a gap/space between two adjacent vehicles in one chain "occupies" the intersection point 160, 370 concurrently with one of the vehicles 122 or 132.

The gap/space can be relatively small (e.g., some small amount more than the outer measurements (such as width) of the vehicle bodies), and safety is provided in part by the use of a synchronization assembly/mechanism used to maintain or control the positions/locations of the vehicles 122, 132 (e.g., by synchronizing the movement of the vehicle chains 124, 134 and/or vehicles along their supporting, separate lower and upper tracks of the omnimover ride assemblies 120, 130). Further, the excitement of the vehicle interactions and near misses can be heightened by having the vehicles 122 and the vehicles 132 placed at the same elevation or height above the floor 112 of the structure 110.

Figure 4:
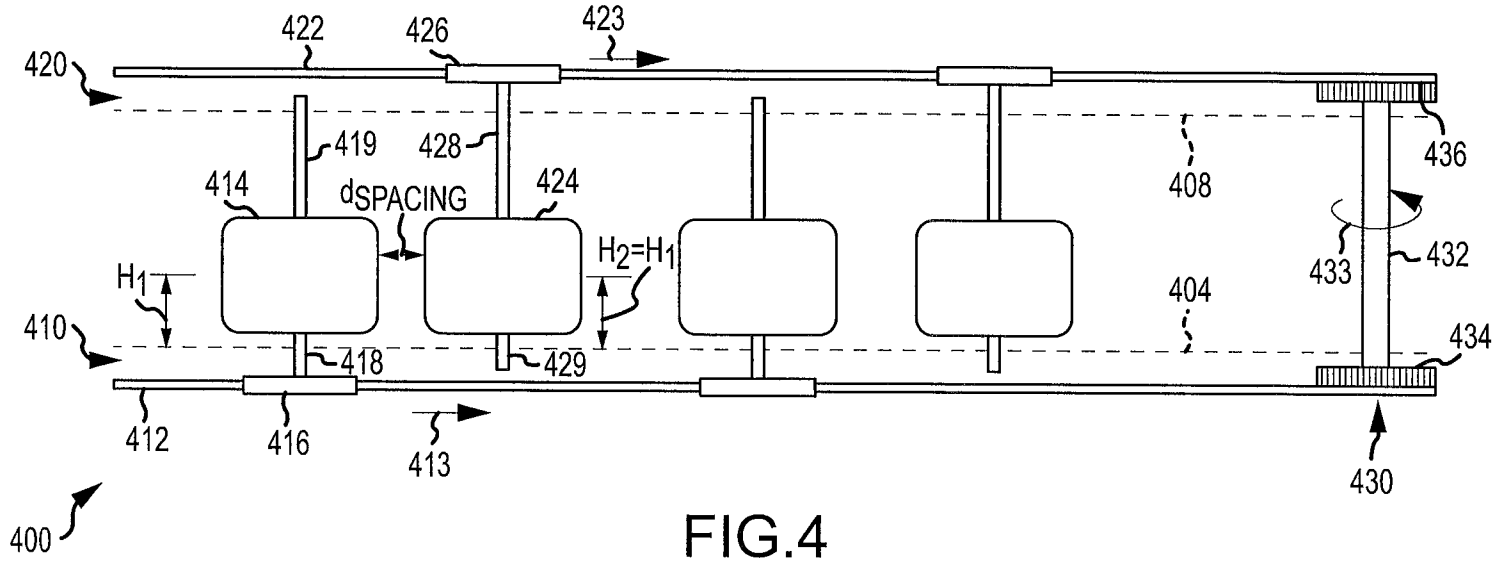
FIG. 4 is a side schematic/functional block view of a ride system of the present invention showing use of an upper and a lower omnimover ride assembly to place vehicles of the two assemblies in adjacent (or intermixed) positions and so as to have the same (or overlapping) vertical positions or heights relative to the floor (and ceiling)

With vehicle elevational position and synchronization in mind, FIG. 4 illustrates (in schematic or functional block form) a portion of a ride system 400. As shown, the ride system 400 includes a lower omnimover ride assembly 410, an upper omnimover ride assembly 420, and a synchronization mechanism or assembly 430. The lower assembly 410 includes a chain of vehicles 414 (that are interconnected in any useful manner such as within the track 412 or a point below false floor 404) that is moved 413 along track 412 by a drive(s) (not shown in FIG. 4) typically at a constant speed such as about 1 to 3 feet per second or the like. The lower track 412 is positioned beneath a false floor 404 in this example although this is not required. The lower assembly 410 includes a number of vehicles such as vehicle 414 that are connected into a continuous loop or chain, which would be guided along the track 412 via bogie or track-mating member 416 of the lower omnimover ride assembly 410.

As shown, the vehicle 414 is connected to the track 412 to move with the vehicle chain along a vehicle or ride path defined by the associated track 412 and, therefore, along the path taken by the chain of vehicles 414 in omnimover ride assembly 410. A linkage or connector 416 links a lower vehicle support 418, which extends upward through the floor 404 where it is coupled with the body of vehicle 414, to the lower track 412. The support 418 may be a pole or post or the like that travels in a slot or groove in the floor 404, and a false or decorative upper vehicle support 419 may be provided that extends up from, the body of the vehicle 414 into a false ceiling 408 (e.g., through a groove or slot in such ceiling 408) to provide the indication that the vehicle 414 may be vertically supported either from above or from below. The body of the vehicle 414 is positioned at an elevation or height, $H_1$, which may be measured from the false floor and coincide with a portion of the vehicle body such as a center point of the vehicle body (or a bottom, a top, or other feature/point).

Further, the ride system 400 includes the upper omnimover assembly 420 that includes a chain of vehicles 424 that is moved 423 along a track structure 422 (an upper track) by a drive assembly or mechanism (not shown). Again, the drive mechanism typically moves the continuous loop or chain of vehicles 424 at a constant speed through operation of the ride system 400, and the speed of movement 423 is matched to the speed of movement 413 of the lower chain of vehicles 414 on track 412. The upper assembly 420 includes a number of vehicles 424 that are supported from above on track 422 and/or connected into the vehicle chains so as to move 423 with as a continuous chain or train of vehicles at one speed 423 on the supporting track 422. For example, a vehicle 424 may be supported at a height or elevation, $H_2$, above the floor 404 by an upper vehicle support 428 attached to its body that is in turn connected to bogie or track-mating member 426 to ride and/or be driven by a drive system.

This height, $H_2$, may be the same or different than the height, $H_1$, of vehicle 414. To provide close calls and more interesting vehicle interaction, the heights, $H_1$ and $H_2$, are often the same in ride system 400 or at least chosen such that the bodies of vehicles 414, 424 would collide if not for the careful synchronization of their locations in the ride 400 (such as at intersections/cross over points as shown in FIGS. 1 and 3). Hence, the vehicles 414, 424 may be vertically supported so as to occupy at least some of the same vertical space (or their profiles pass at least partially overlap When passing through an intersection or cross over point).

To this end, the upper support 428 is chosen to have a length such that it extends through the ceiling 408 (such as through a groove/slot) to hang the vehicle 424 at the height, $H_2$, above the floor 404. A lower vehicle support 429 that is false/decorative may be provided that extends down from the body of the vehicle 424 into the floor 404 (e.g., through a groove/slot similar to the vehicle 414 and its support 418) so as to give the appearance that the vehicle 424 may be supported from above and/or below. At one end, the support 428 is attached to a linkage/connector 426 bound to the track 422 to allow the support 428 and attached vehicle 424 to move 423 along the upper track 422 provided in upper omnimover ride assembly 420.

The matching or synching of the movements 413, 423 may be achieved in part through the use of the synchronization mechanism or assembly 430. The synchronization mechanism 430 is adapted to guarantee spacing and timing of the vehicle chains along tracks 412, 422 such that the positions and spacing of the vehicles 414, 424 remains consistent through operation of the ride system 400. The synchronization mechanism 430 is shown to be of a mechanical nature in this system 400 and functions to connect the over/upper chain of vehicles 424 to the under/lower chain of vehicles 424 such that the movements 413 and 423 have to remain equal.

To this end, the synchronization mechanism 430 includes a lower connector 434 physically contacting and moving with the under/lower chain (e.g., a gear or cog wheel linked to vehicle chain or its drive/interconnected members or components, which may include a chain or the like with openings for receiving the teeth of the gear 434). A shaft or axle 432 extends from the lower connector 434 to an upper connector 436, which physically contacts and moves with over/upper chain (e.g., a gear or cog wheel linked to or engaging the vehicle chain or its drive/interconnection members or components, which may be a chain or similar element(s)). The shaft or axle 432 turns 433 with both the connectors 434, 436 and is a rigid member such that these connectors 434, 436 are forced to turn at the same rate and the vehicle chains of vehicles 414, 424, likewise, move 413, 423 in a synchronized manner. In this example system 400, the under and over chains riding on lower and upper tracks 412, 422 are mechanically linked to guarantee the relative movement of the two vehicle chains and their supported vehicles 414, 424. The chains and their associated tracks are supported or positioned at different elevations such that the vehicle paths from the separate omnimover assemblies 410, 420 can cross (When viewed in plan view) without interference.

Figure 5:
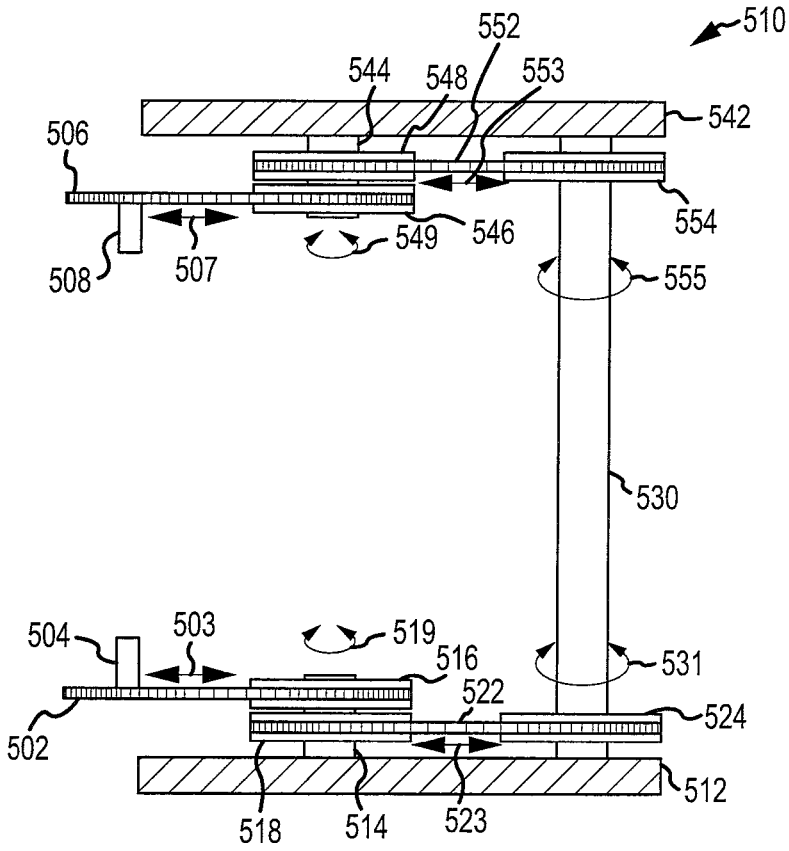
FIG. 5 illustrates a partial side view of a ride system showing a track synchronization assembly (or mechanism) useful for synchronizing the speeds/movements of an upper and a lower vehicle chain so as to maintain desired relative positions of vehicles mounted on (or supported by) the two omnimover tracks and driven by the separate vehicle chains.

FIG. 5 illustrates another exemplary synchronization mechanism or assembly 510 that may be used in ride systems of the present invention to mechanically couple an upper vehicle chain and a lower vehicle chain. In the assembly 510, a lower mounting base or pedestal 512 is provided as is an upper mounting base or pedestal 542. A shaft or axle 530 is pivotally mounted to these two mounting pedestals 512, 542. At a first or lower end of the shaft 530, a gear/wheel 524 is rigidly affixed such that the shaft 530 rotates 531 with the gear/wheel 524. To this end, a lower chain coupling shaft 514 is pivotally mounted on base 512 and it rotates 519 with movement 503 of a lower vehicle chain 502 (to which vehicles (not shown) are linked into from below via attachment/support 504 or are linked together to form chain 502 as is well known with use of conventional omnimovers). The lower vehicle chain 502 (or a drive portion of a lower vehicle chain) mates with a gear/wheel 516 that is rigidly bound to the coupling shaft 514. To pass movement 503 of the chain 502 to the synchronizing axle 530, the synchronization assembly 510 includes a gear/wheel/sprocket 518 affixed to the coupling shaft 514, and a synchronizing member (such as a chain or belt) 522 mates with the gear 518 to move 523 with rotation 519 of coupling shaft 514 so as to cause the gear 524 and coupled shaft 530 to rotate 531.

At the other end of the shaft 530, a gear/wheel/sprocket 554 is affixed to cause the shaft 530 to rotate 555 (or vice versa), and the rotation rate 555 and 531 are synched or matched due to the rigidity of the shaft/axle 530. The upper vehicle chain or chain of vehicles 506 (which drives and is linked to or formed of linked vehicles (not shown) from above via support 508) moves 507 at a rate that is matched to the rate 503 (and vice versa) by the synchronization mechanism 510. As the upper chain of vehicles 506 moves 507 it drives or rotates 549 a coupling shaft 544 pivotally mounted to upper mounting base 542 via gear/Wheel 546, which is rigidly attached to the coupling shaft 544. Another gear/wheel 548 is affixed to the coupling shaft 544 and rotates 549 with the shaft 544 so as to cause a synchronizing member 552 (e.g., a chain, belt, or the like) to move 553, and this causes the shaft 530 to rotate 55 via gear/wheel connection 554. In this manner, the lower vehicle chain 502 and upper vehicle chain 506 are mechanically coupled via synchronization mechanism 510 such that their movements 503 and 507 are closely matched or synchronized to be equal or substantially equal through operation of a ride system including the mechanism 510, which controls or retains the relative positions of vehicles coupled to the vehicle chains 502, 506 via supports/links 504, 508 with the chains 502, 506 moving along lower and upper fixed tracks (upon which the vehicles may ride in some cases).

Figure 6:
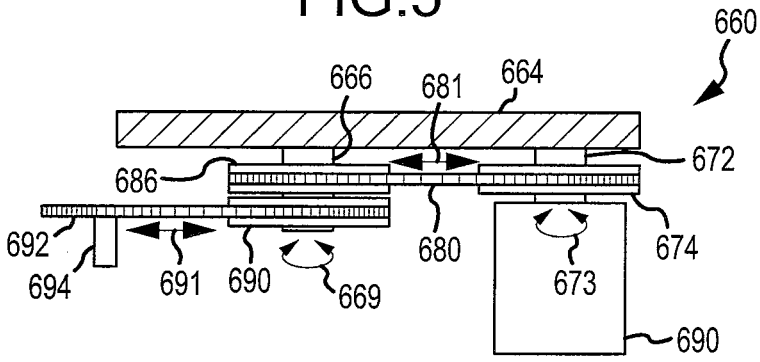
FIG. 6 shows an exemplary drive assembly (or drive mechanism) that may be used to drive an omnimover vehicle chain of a ride system of the present invention.

One or more drive mechanisms or assemblies may be provided for each chain of vehicles 502, 506 or only one of the vehicle chains 502, 506 may be driven and a synchronization device such as mechanism 510 may be used to drive the second coupled vehicle chain. A number of drive devices may be used, but FIG. 6 illustrates one exemplary drive assembly 660 and its connections to a vehicle chain 692 (e.g., an upper chain of vehicles interconnected in a continuous loop and riding along an upper track of an upper omnimover ride assembly). The vehicle chain 692 may take the form of a chain as shown for simplicity sake or may be a portion of a drive system or interconnection elements for the vehicles providing the links of the vehicle chain 692, and a track may be used to support from above a number of vehicles connected to form the chain 692 via upper vehicle supports/attachments 694.

A support or mounting base/pedestal 664 is provided and used to pivotally support a coupling shaft 666, and a drive motor 670 is provided in the assembly 660 and is operated to rotate 673 an output or drive shaft 672. A gear/sprocket 674 is affixed to the drive shaft 672 to rotate with the shaft 672, and a drive member 680 (e.g., a drive belt, chain, or the like) is mated with the gear/sprocket/wheel 674 to move 681 in response to rotation 673 of the drive shaft 672. A gear/sprocket/wheel 686 is likewise affixed to the coupling shaft 666 such that the coupling shaft 666 rotates 669 in response to movement 681 of the drive chain 680. A drive output gear/sprocket/wheel 690 is also affixed to the coupling shaft 666 and receives or engages the upper vehicle chain 692 (or an interconnecting member or driven portion of such vehicle chain 692) such that the chain 692 is driven to move 691 with shaft rotation 669 such as at one or more constant speeds as is typically useful with omnimovers. In general, the drive motor and sync connections may be duplicated as many times as useful to manage peak tension in the omnimover vehicle chains.

The above examples have explained the ride system concepts of the present invention with reference to two track configurations, but other embodiments of rides may include three, four, or more omnimover ride assemblies. This may be useful for adding additional passenger vehicles to a ride or to insert or present vehicles carrying show elements that interact with passenger vehicles (pass between adjacent ones).

Figure 7:
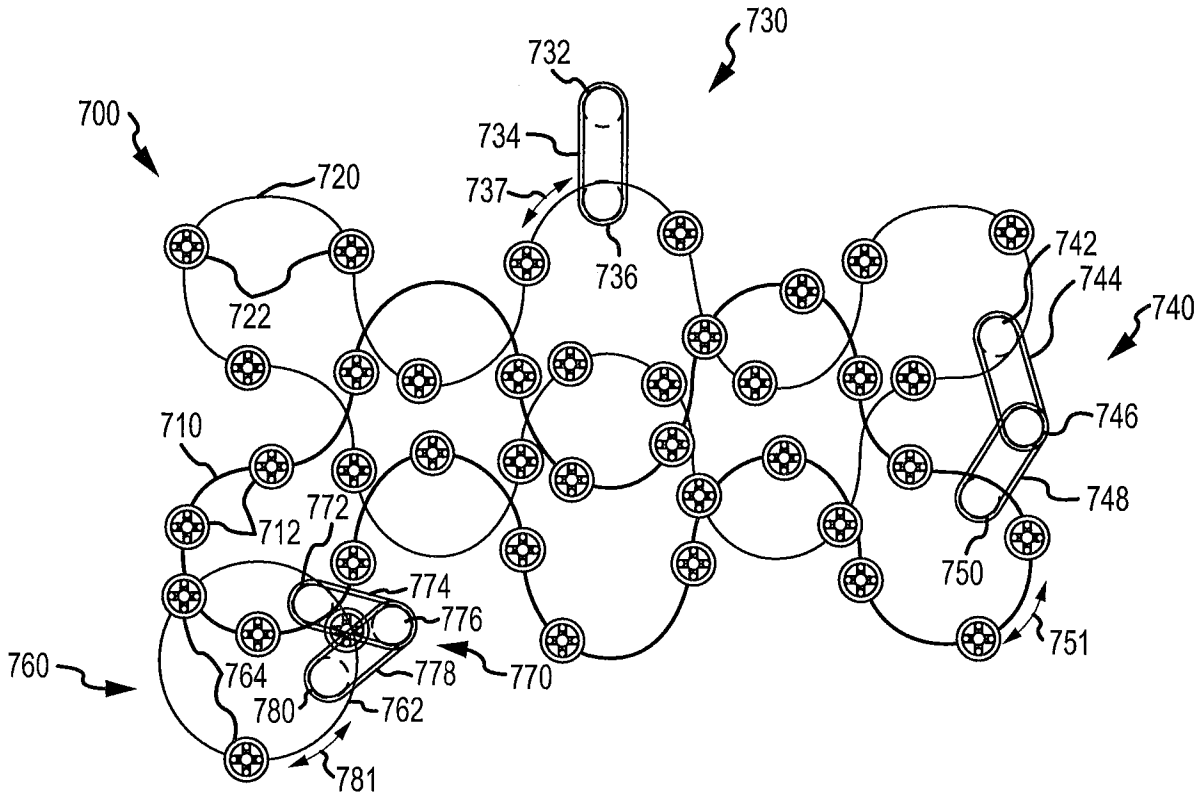
FIG. 7 illustrates a plan view of another embodiment of a ride system showing three synchronized vehicle chains of three omnimover assemblies in which each may be used for passenger vehicles or one or two may be used to provide relative, synchronized movement of show elements/features within the ride system (e.g., cause a show element to pass between two passenger vehicles linked into an omnimover vehicle chain).

For example, FIG. 7 shows a ride system 700 that includes a lower vehicle chain 710 (and associated fixed track), a first upper vehicle chain 720 (and associated fixed track), and a second upper vehicle chain 760 (and associated fixed track). In other words, the ride system 700 include a lower omnimover assembly that includes the lower vehicle chain 710 (with its track and portions of its drive and interconnecting features under a floor) used to move a number of passenger vehicles 712 about a first ride or vehicle path. The ride system 700 also includes a first upper omnimover assembly that includes the upper vehicle chain 720 (with its track and portions of its drive and interconnecting features above an optional false ceiling) that is used to move a number of passenger vehicles 722 along a second ride or vehicle path. The first and second vehicle paths differ and include numerous cross over points or intersections at which the vehicles may pass in proximity to vehicles of the other omnimover assembly and at which the "intersection" is apparent in plan view but occurs without interference between the vehicle chains 710, 720 (and their associated fixed-position or non-moving tracks) due to these vehicle chains 710, 720 (and their associated tracks) being positioned at differing elevations (e.g., at a first elevation below a floor and a second elevation above a ceiling of the ride system 700 such as to provide a gap of 10 to 20 feet or more in many cases).

The ride system 700 further includes a third omnimover assembly 760 that includes an upper this non-limiting example) vehicle chain 762 (and associated fixed-position track structure) that crosses over the lower track 710 in plan view but is provided at a different elevation to avoid true interference (e.g., at the same elevation as chain 720 and/or above a ceiling in the ride system 700). The assembly 760 includes vehicles 764 supported from above by a track associated with vehicle chain 762, and these vehicles 764 may be used to position show elements near vehicles 712 (between or in near miss positions with vehicles 712 at cross over points between vehicle chains 710 and 762).

The ride system 700 is configured such that the three vehicle chains 710, 720, and 762 are driven or moved 737, 751, 781 in a synchronized manner to retain a desired relative positioning of the vehicles 712, 722, 764 throughout the ride system 700 as the vehicle chains 710, 720, 720 move along the paths associated with three fixed-position tracks as shown in FIG. 7. To this end, a drive assembly 730 is provided that is used to drive the upper vehicle chain 720 as shown by arrow 737. A drive motor 732 is used to drive a drive member 734 such as a drive chain, belt, or the like, and this causes a drive gear/sprocket/wheel 736 that is engaging portions of the upper vehicle chain 720 (such as portions near the support track) to rotate to move/drive 737 the upper vehicle chain 720 along an upper track.

The movement 737, 751 of the two vehicle chains 710, 720 along their structural support tracks is synchronized by the synchronization assembly 740, which also drives movement 751 of the lower vehicle chain 710 as only one drive 730 is used in the ride system 700. The sync assembly 740 may take the form shown for assembly 510 in FIG. 5. As shown in FIG. 7, the assembly 740 includes a gear/sprocket/wheel 742 that engages the upper vehicle chain 720 (or a portion thereof used for interconnecting and/or driving the vehicles 722) such that it rotates with the movement 737 of the vehicle chain 720. This causes a sync chain/member 744 to move, which, in turn, causes a sync shaft/axle 746 to rotate about its longitudinal axis. As a result, a second sync chain/member 748 moves to cause a gear/sprocket/wheel 750 to rotate, which drives the lower vehicle chain 710, along its associated lower track, that it is mating with (or engaging) to move 751 at the same rate as the upper vehicle chain 720 due to operation of drive 730.

Likewise, a similar sync assembly 770 may be used to synchronize the movement 781 of the second upper vehicle chain 762 (and to drive this chain and the vehicles 764 that are linked together to form the chain 762 along an upper track with drive 730). As shown, the sync assembly 770 includes a gear/sprocket/wheel 772 engaging the lower vehicle chain 710 and mounted to rotate when the chain 710 moves 751. A sync chain/member 774 engages the gear 772 and moves to rotate gear/sprocket/wheel 776 (which it also engages/mates with). A second sync chain/member 778 engages the gear/sprocket 776 such that it moves with the gear 776 to cause a drive/output gear or sprocket 780 to rotate at the same rate, which causes the second upper vehicle chain 762 to move 781 at the same rate as the chains 710, 720. This synchronizes movement of the vehicles 764 (which are supported from above by track 762) relative to the vehicles 712 to avoid collisions as the vehicle chain 762 and its associated track crosses over the chain 710 and its associated track (intersects when viewed in plan view as shown although the chains 710, 762 and associated tracks are at differing elevations so as to avoid true interference at the cross over points).

It will be understood that multiple methods of propulsion and synchronization may be used to practice the ride systems of the present invention. A primary goal is to connect the two (or more) vehicle chains of the omnimovers in a way so as to guarantee vehicle spacing/timing, thereby ensuring safe and reliable path crossing of the vehicles connected into these vehicle chains. The synchronization assembly or mechanism may include a control system that coordinates the motion of independent electric (or other types) of drive systems, which are used in a ride system to separately move the upper and lower vehicle chains along track structures. Such a control system typically would include a processor running control software that is adapted to cause a computer/controller to monitor and adjust positions and speeds of the two vehicle chains along the associated tracks to ensure ongoing synchronization of the two chains and their vehicles. The use of independently driven vehicle chains is desirable in some ways as it provides a simpler, less complex system as there is no need for a mechanical coupling of the two vehicle chains. However, the vehicles in each omnimover assembly or attached into each vehicle chain would have to be spaced apart further to allow for the expected stopping distance based on the reaction time of the control system (e.g., the close calls would have to be less "close").

Hence, mechanical coupling may be provided in the synchronization assembly/mechanism. For example, the synchronization assembly may include a single drive system that is used to drive both the upper and lower vehicle chains. In one such arrangement, this is performed at or near a location where the upper and lower tracks and their support vehicle chains overlap (in plan view), and it may take the form of the synchronization shaft/axle 530 being driven, in other cases, though, the synchronization assembly uses a non-driven (and not actively controlled) mechanical linkage that connects the upper and lower vehicle chains. This may occur at or near a location where the tracks and their vehicle chains overlap and may take the form of the mechanism 510 shown in FIG. 5 (e.g., with the axle 530 not being driven or controlled). With such a mechanical coupling, the spacing between adjacent vehicles can be relatively small such as a few feet or the like more than an outer dimension of the vehicle that will pass through the two adjacent vehicles (e.g., a spacing greater than a width of the vehicle or greater than the vehicle length when an track/ride path overlap section is used at loading and/or unloading or another portion of the ride).

Although the invention has been described and illustrated with a certain degree of particularity, it is understood that the present disclosure has been made only by way of example, and that numerous changes in the combination and arrangement of parts can be resorted to by those skilled in the art. The ride systems described above typically will include relatively small and intimate vehicles (e.g., 2-4 passenger vehicles or the like). The ride systems deliver exciting and unexpected near-miss experiences to the passengers while also allowing for more standard dark ride show scenes to be presented to the passengers in the moving vehicles. The ride systems have the potential to deliver high attraction capacities with two (or more) vehicle chains providing the same or higher capacity as a conventional omnimover ride.

The vehicles are spaced further apart (in each chain or within each omnimover ride assembly) allowing for more intimate or private (within each vehicle) interactions with the show and with "triggered" effects that may be directed toward a specific vehicle rather than a set, of passing vehicles. The ride systems may be used to provide two or more differing ride experiences on the two or more ride paths, which may encourage repeat rides to experience differing show elements, ride experiences (vehicle spins, track dips/rises, and so on), and the like. The cross over points and overlapping sections of the tracks allow the ride system to be designed to provide a dynamic and/or chaotic show environment with lots of interesting and unpredictable vehicle motion throughout the show spaces.

We claim:

1. A ride system providing crossing vehicle paths, comprising:

a lower assembly including a first track and a first set of vehicles movable along a first ride path defined by the first track, the first vehicle set being vertically supported above the first track of the assembly at a first height;

an upper assembly including a second track and a second set of vehicles movable along a second ride path defined by the second track, the second vehicle set being vertically supported below the second track of the upper assembly at a second height, wherein the second track is spaced apart from and at a higher elevation than the first track; and a synchronization mechanism operating to synchronize movements of the first and second vehicle chains, wherein a rate of movement of the first vehicle chain is equal to a rate of movement of the second vehicle chain, wherein the first ride path crosses the second ride path at a cross over point when the ride system is viewed in plan view, and wherein the vehicles of the first and second vehicle sets are supported within first and second ranges of elevations at the cross over point, the first and second elevation ranges at least partially overlapping.

2. The system of claim 1, wherein the first path differs from the second path.

3. The system of claim 2, wherein adjacent ones of the vehicles in the lower assembly and in the upper assembly are spaced apart at least a length of a body of one of the vehicles and wherein the vehicles are positioned on the first and second ride paths such that the vehicles from each of the lower and upper assemblies alternately pass through the cross over point without contacting other ones of the vehicles.

4. The system of claim 1, wherein the first and second ride paths coincide, when the ride system is viewed in plan view, for a length greater than about two of the vehicles.

5. The system of claim 4, wherein the vehicles are positioned relative to each other in the lower and upper assemblies such that in the coinciding length of the first and second ride paths the vehicles from the upper and lower assemblies are alternated.

6. The system of claim 1, wherein the synchronization mechanism includes coupling assembly mechanically coupling the first vehicle set to the second vehicle set.

7. The system of claim 6, wherein the synchronization mechanism comprises a drive mechanism driving a first one of the first and second vehicle sets to move along the first or second ride path, whereby the second one of the first and second vehicle chains is driven to move along the other of the first and second ride paths via the coupling assembly.

8. The system of claim 1, wherein the synchronization mechanism comprises first and second electric drives operated by a control system to drive the first and second vehicle sets, respectively, and to provide ongoing synchronization of the rates of movement of the first and second vehicle sets.

9. A ride apparatus, comprising:

a lower assembly with a plurality of vehicles supported by a lower track and configured to travel along a lower ride path defined by the lower track, wherein the vehicles of the lower assembly are positioned above the lower track at a first elevation;

an upper assembly with a plurality of vehicles supported by an upper track and configured to travel along an upper ride path defined by the upper track, wherein the vehicles of the upper assembly are positioned below the upper track at a second elevation that is substantially equal to the first elevation, wherein the lower track and the upper track appear to intersect at a plurality of cross over points when the tracks are viewed in plan view; and a synchronization mechanism synchronizing movements of the vehicles on the lower track to movements of the vehicles on upper track, wherein the synchronization mechanism mechanically couples the vehicles on the lower track to the vehicles on the upper track such that the vehicles on the lower and upper tracks move at substantially the same speed along the lower and upper ride paths.

10. The apparatus of claim 9, wherein the vehicles are arranged on the upper and lower tracks such that the vehicles of the upper assembly are spaced apart from proximate ones of the vehicles of the lower assembly as the vehicles move through the cross over points of the upper and lower tracks.

11. The apparatus of claim 9, wherein the upper and lower tracks appear to overlap in a segment having a length greater than at least two times a length of a body of one of the vehicles.

12. The apparatus of claim 11, wherein the vehicles of the upper and lower assemblies are positioned adjacent to each other in the segment.

13. The apparatus of claim 9, wherein the upper and lower tracks are each configured as a continuous loop and the vehicles on the upper and lower tracks are connected in continuous chains that are driven at one or more speeds during operation of the apparatus by at least one drive engaging one of the upper and lower chains of the vehicles.

* * * * *